US006467891B2

(12) United States Patent
Moriyama et al.

(10) Patent No.: US 6,467,891 B2
(45) **Date of Patent: *Oct. 22, 2002**

(54) INK-JET PRINTING APPARATUS AND PRINTING METHOD

(75) Inventors: Jiro Moriyama, Kawasaki; Tetsuro Inoue, Tokyo; Masao Kato; Minako Kato, both of Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/021,273

(22) Filed: Feb. 10, 1998

(65) Prior Publication Data

US 2002/0015085 A1 Feb. 7, 2002

(30) Foreign Application Priority Data

Feb. 14, 1997 (JP) ..... 9-030135

(51) Int. Cl.[7] ..... B41J 2/17
(52) U.S. Cl. ..... 347/96
(58) Field of Search ..... 347/15, 43, 41, 347/101, 96

(56) References Cited

U.S. PATENT DOCUMENTS 5,959,641 A 9/1999 Yokoi ..... 347/21
6,102,537 A 8/2000 Kato et al. ..... 347/101

FOREIGN PATENT DOCUMENTS

| | | |
|---|---|---|
| EP | 0 703 087 | 3/1996 |
| EP | 0 726 155 | 8/1996 |
| EP | 0 726 158 | 8/1996 |
| JP | 5-229112 | 9/1993 |
| JP | 6-278277 | 10/1994 |
| JP | 8-72229 | 3/1996 |
| JP | 8-281933 | 10/1996 |

*Primary Examiner*—Thinh Nguyen
*Assistant Examiner*—Michael S Brooke
(74) *Attorney, Agent, or Firm*—Fitzpatrick, Cella, Harper & Scinto

(57) ABSTRACT

A preliminary process for ejecting an ink after ejecting a processing liquid on a printing medium and a post-process for ejecting the processing liquid after ejecting the ink on the printing medium are distinguished. In one preferred mode, when a preliminarily process portion, in which an ink dot is formed after formation of a processing liquid dot, and a post-process portion, in which the processing liquid dot is formed after formation of the ink dot are present in admixing fashion, an ejection amount of the ink per unit area in the post-process portion is made smaller than the ejection amount of the ink per unit area in the preliminarily process portion. By this, a difference of printing quality in the preliminarily process portion and the post-process portion on the printing medium can be made smaller.

13 Claims, 6 Drawing Sheets

INK-JET PRINTING APPARATUS AND PRINTING METHOD

This application is based on patent application Ser. No. 30135/1997 filed Feb. 14, 1997 in Japan, the content of which is incorporated hereinto by reference.

BACKGROUND OF THE INVENTION

Field of the Invention

The present invention relates generally to an ink-jet printing apparatus and a printing method, by which a high quality image can be obtained on a printing medium. More specifically, the invention relates to an ink-jet printing apparatus and a printing method, in which a processing liquid making a component contained in an ink insoluble or coagulated is ejected before or after ejection of the ink.

The present invention is applicable for all apparatus using paper, cloth, leather, OHP film, other metals and the like as a printing medium. Particular applicable apparatus are business machines, such as a printer, a copy machine, a facsimile, industrial production machines and so on.

DESCRIPTION OF THE RELATED ART

Conventionally, an ink-jet printing method has been widely employed in a printer, a copy machine and so on for easiness of lowering of noise, lowering of a running cost, down-sizing of apparatus, providing capability of color printing of a printing image and for other reasons.

However, in the printing apparatus utilizing such ink-jet printing method, when an image is printed on a plain paper, the water resistance of the image can be insufficient. On the other hand, when a color image is to be printed, it has been not possible to achieve both of a high density image causing no feathering and an image not causing blotting between colors. Thus, it has been difficult to obtain a satisfactory fastness of the image and a sufficiently high quality of color image.

On the other hand, in the recent years, as a method for improving water resistance of the printed image, an ink, in which a coloring agent contained therein is provided with a water resistance, has been practiced. However, the water resistance of the ink is still insufficient. In addition, such ink is principally an ink to be difficult to be solved in water after drying to easily cause plugging with ejection openings of a printing head and thus to make construction complicate for a measure to prevent plugging.

Also, in the prior art, there has been proposed technologies for improving fastness by preliminary process or post-process of the printing medium. The preliminary process is to provide certain processes on the printing medium before printing of the image by the ink. The post-process is to provide certain process on the printing medium after printing the image by the ink.

However, in the prior art set forth above, no consideration has been given for the possibility of the occurrences of differences of printing quality when both preliminarily process portions and post-process portions are present on the printing medium in admixing manner, and for preventive measures therefor.

SUMMARY OF THE INVENTION

It is an object of the present invention to discriminate a preliminary process for ejecting an ink after preliminarily ejecting a processing liquid and a post-process for ejecting the processing liquid after ejecting the ink, to restrict a different of printing quality in a preliminary process portion and a post-process portion on a printing medium.

In a first aspect of the present invention, there is provided an ink-jet printing apparatus using an ink ejecting head capable of ejecting an ink, and a processing liquid ejecting head capable of ejecting a processing liquid which makes a coloring agent in the ink insoluble or coagulated, an ink dot being formed on a printing medium by the ink ejected from the ink ejecting head, and a processing liquid dot being formed on the printing medium by the processing liquid ejected from the processing liquid ejecting head, for forming a preliminarily process portion, in which the ink dot is formed after formation of the processing liquid dot, and a post-process portion, in which the processing liquid dot is formed after formation of the ink dot, the apparatus comprising:

control means for differentiating at least one of an ejection amount of the ink per unit area and an ejection amount of the processing liquid per unit area between the preliminarily process portion and the post-process portion.

In a second aspect of the present invention, there is provided an ink-jet printing method using an ink ejecting head capable of ejecting an ink, and a processing liquid ejecting head capable of ejecting a processing liquid which makes a coloring agent in the ink insoluble or coagulated, an ink dot being formed on a printing medium by the ink ejected from the ink ejecting head, and a processing liquid dot being formed on the printing medium by the processing liquid ejected from the processing liquid ejecting head, for forming a preliminarily process portion, in which the ink dot is formed after formation of the processing liquid dot, and a post-process portion, in which the processing liquid dot is formed after formation of the ink dot, the method comprising the step of:

differentiating at least one of an ejection amount of the ink per unit area and an ejection amount of the processing liquid per unit area between the preliminarily process portion and the post-process portion.

By the present invention, when the preliminary process portions for ejecting an ink after ejecting the processing liquid on the printing medium and the post-process portions for ejecting a processing liquid after ejecting the ink are present on the printing medium in admixing manner, at least one of an ejection amount of the ink or an ejection amount of the processing liquid per unit area of the preliminary process portion and the post-process portion is differentiated, to restrict the difference of a printing quality on the preliminary process portion and the post-process portion.

The above and other objects, effects, features and advantages of the present invention will become apparent from the following description of embodiments thereof taken in conjunction with the accompanying drawings.

DETAILED DESCRIPTION OF THE PREFERRED EMBODIMENTS

The preferred embodiments of the present invention will be explained with reference to the drawings.

(First Embodiment)

Figure 1:
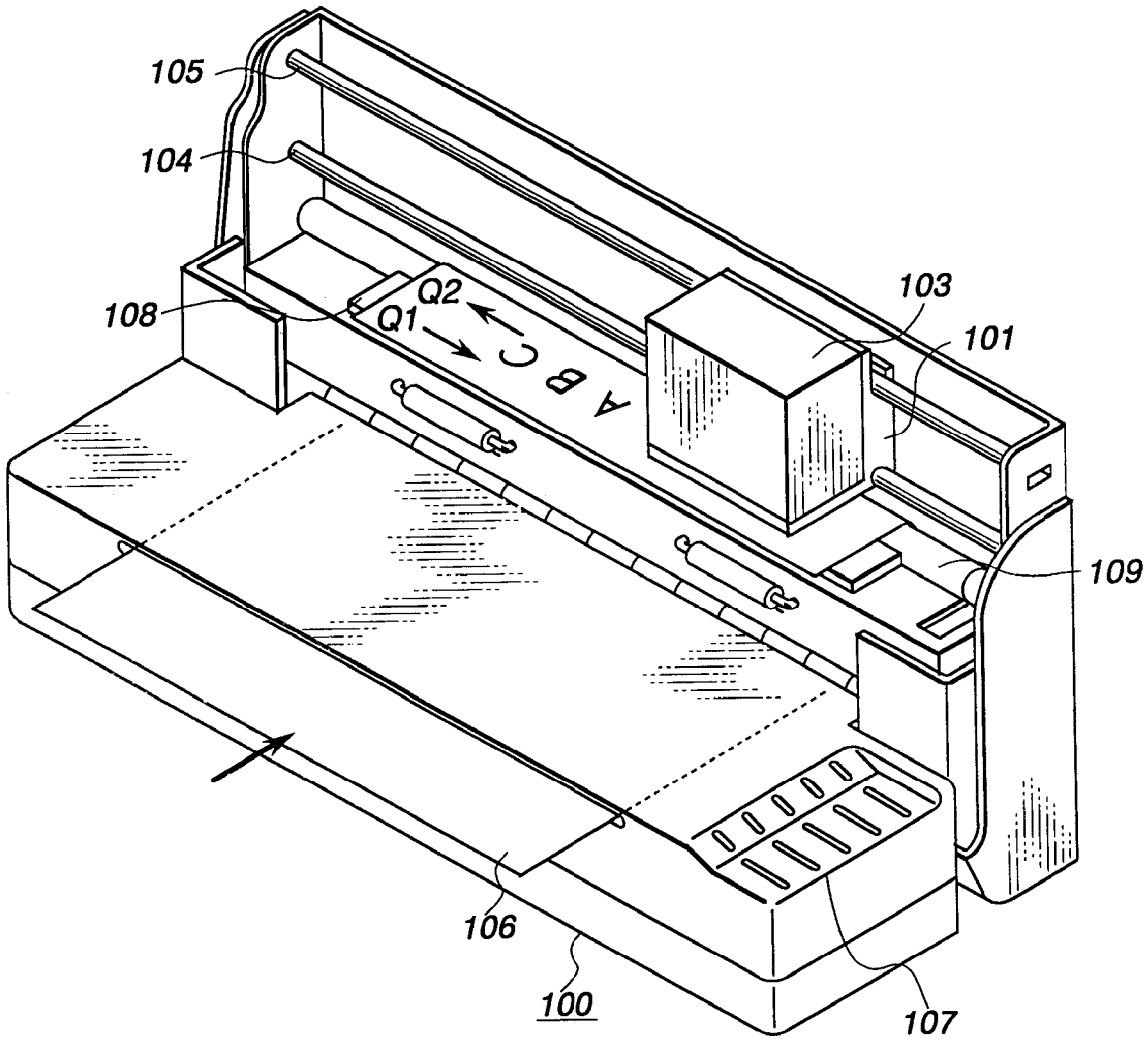
FIG. 1 is a perspective view of a printing apparatus, to which the present invention is applicable.

FIG. 1 is a perspective view of an ink-jet printing apparatus, to which the present invention is applicable. A printing medium 106 inserted into a paper supply position of a printing apparatus, is fed in a direction of arrow P by a feeding roller 109. Then, the printing medium 106 is transported to a printable region for a printing head 103. In the printable region, a platen 108 is provided at a position opposing to the lower face of the printing medium 106. A carriage 101 is movably guided by two guide shafts 104 and 105 in a direction along axes of the guide shafts for reciprocally scanning in the printable region in directions of arrows Q1 and Q2. A printing head 103 to be mounted on the carriage 101 is constructed with an ink ejecting head which can eject a plurality of inks of different colors, a processing liquid ejecting head which can eject a processing liquid, an ink tank storing inks to be supplied to the ink ejecting head and a processing liquid tank storing the processing liquid to be supplied to the processing liquid ejecting head. In the shown embodiment, a plurality of inks of different colors are inks of Bk (black), C (cyan), M (magenta) and Y (yellow).

The reference numeral 107 denotes an arrangement portion of switch parts and display element parts. The switch parts are used for turning ON/OFF of a power source of the printing apparatus and setting of various printing modes, and display element parts perform the operation for displaying a condition of the printing apparatus.

Figure 2:
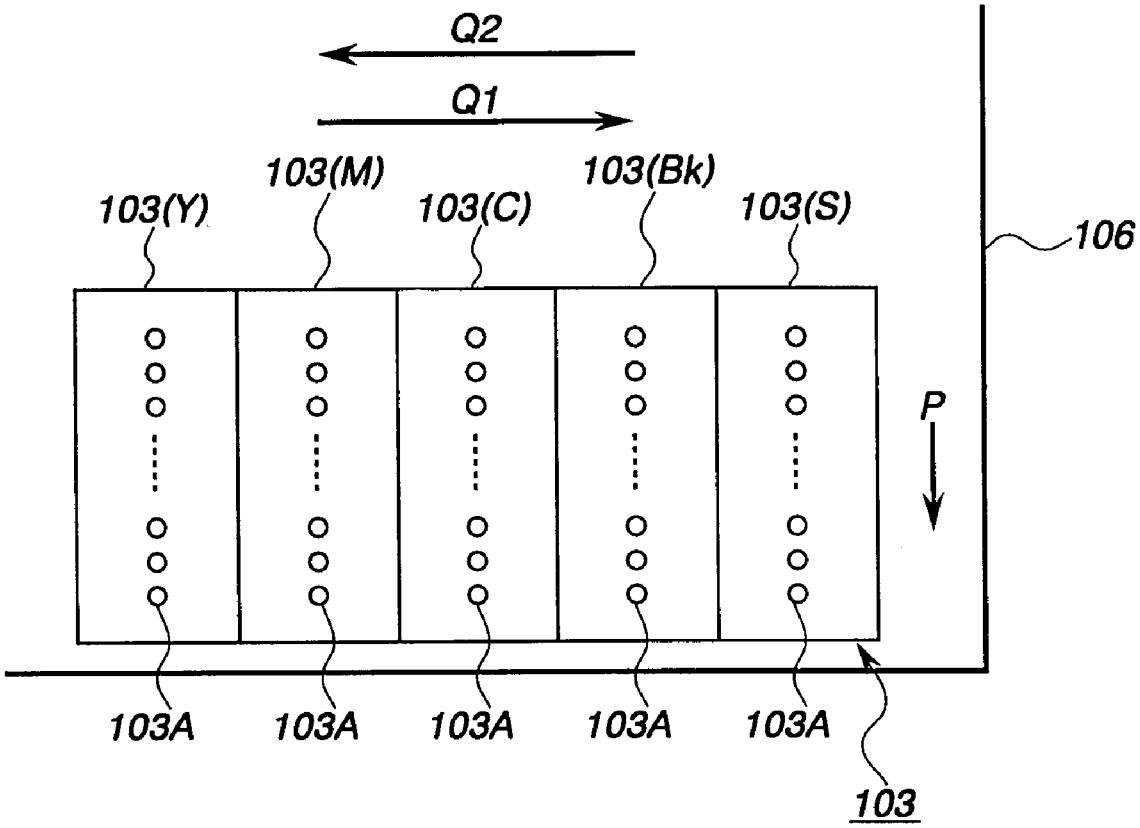
FIG. 2 is an explanatory illustration of an arrangement of ejection openings in a printing head.

FIG. 2 shows an arrangement of ejection openings 103A of the printing head 103, and is a diagrammatic illustration of the printing head 103 seen through from the upper portion side of the printing medium 106. The reference numerals 103(Y), 103(M), 103(C) and 103(Bk) denote ink ejecting heads for ejecting inks of yellow, magenta, cyan and black, and the reference numeral 103(S) denotes a processing liquid ejecting head for ejecting the processing liquid. The printing head 103 moves in a main scanning direction of arrows Q1 and Q2 with respect to the printing medium 106. The printing medium 106 is transported in a sub scanning direction of an arrow P with respect to the printing head 103. Number of ejection openings 103A of respective ink ejecting heads 103(Y) to 103(Bk) and the processing liquid ejecting head 103(S) is one hundred twenty-eight. A pitch of the ejection openings 103A is about 70 $\mu$m.

An interval of the ejection openings 103A of respective heads 103(Y) to 103(Bk) and 103(S) in the main scanning direction of the arrows Q1 and Q2 is set to be one hundred eighty times of the diameter of the ejection opening 103A. The ejection openings 103A of each head 103(Y) to 103(Bk) and 103(S) are linearly arranged in a direction substantially perpendicular to the main scanning direction. On the other hand, respective heads 103(Y) to 103(Bk) and 103(S) are arranged in serial in the main scanning direction so that the lower ends thereof may match with each other in the main scanning direction of the printing heads 103. Each of the heads 103(Y) to 103(Bk) and 103(S) can eject the ink or the processing liquid using thermal energy, and has a plurality of electrothermal transducers for generating the thermal energy. By the thermal energy generated by the electrothermal transducer, film boiling is caused in the ink or the processing liquid. Utilizing pressure variation caused due to growth and contraction of bubble by film boiling, the ink or the processing liquid is ejected through the ejection opening 103A.

Figure 3:
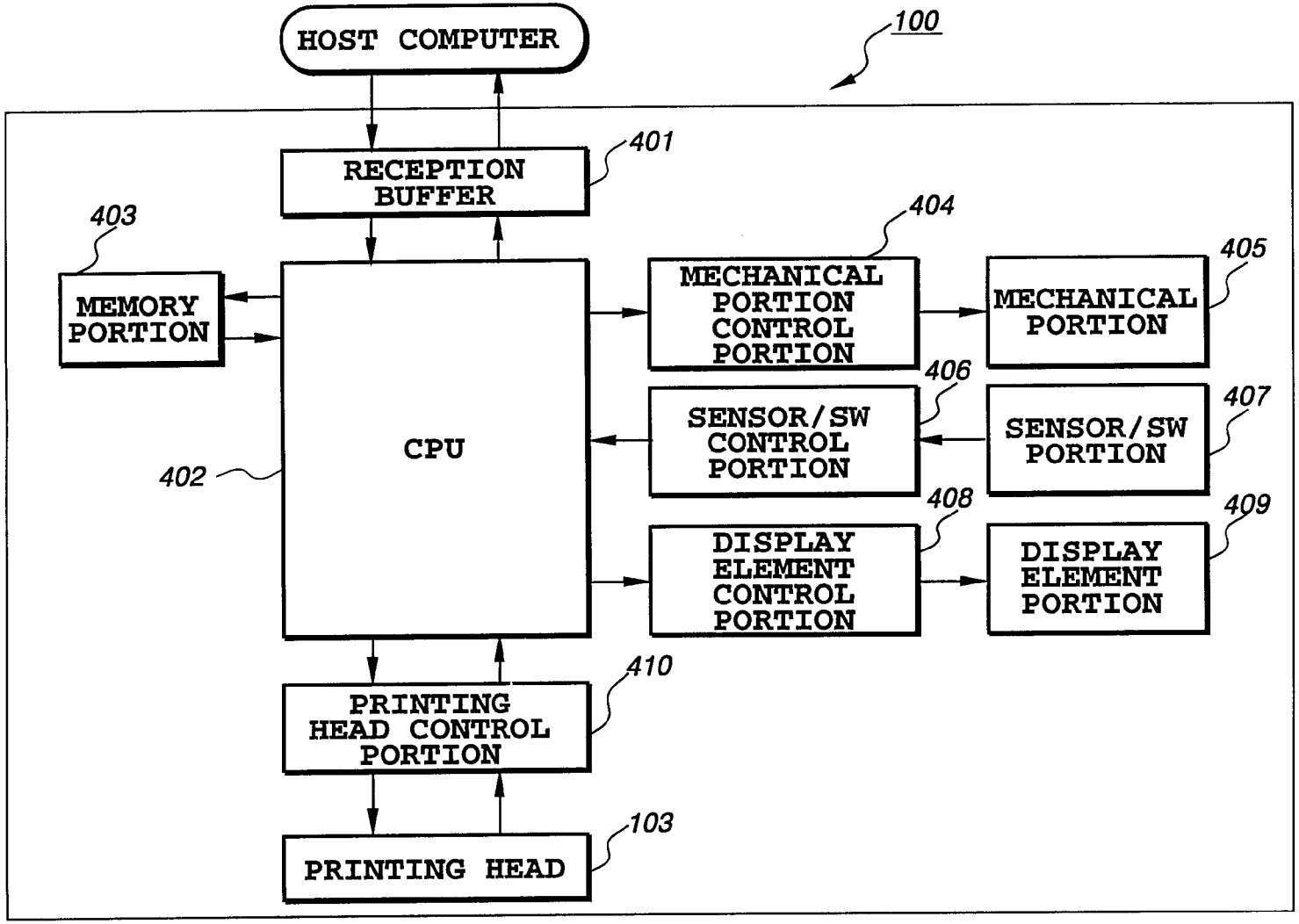
FIG. 3 is a block diagram of a control system of the printing apparatus, to which the present invention is applicable.

FIG. 3 is a block diagram of the ink-jet printing apparatus, to which the present invention is applicable. From a host computer, data of character and graphic image to be printed is input to a reception buffer 401 of the printing apparatus 100. On the other hand, data for confirming correct transmission of data and data for notifying operating condition of the printing apparatus 100 are transmitted to the host computer. Data of the reception buffer 401 is transferred to a memory portion 403 under management of CPU 402, and is temporarily stored in RAM (random access memory) of the memory portion 403. A mechanical portion control portion 404 drives and controls a mechanical portion 405, such as a carriage motor, a line feeding motor and the like, in response to a command from CPU 402. A sensor/SW control portion 406 feeds signals from a sensor/SW portion 407 consisted of various sensors and SWs (switches) to CPU 402. A display element control portion 408 controls a display element portion 409 consisted of LED, liquid crystal element or the like of a display panel group, in response to a command from CPU 402. A printing head control portion 410 controls the printing head 103 in response to a command from CPU 402. On the other hand, the printing head control portion 410 detects a temperature information and the like indicative of condition of the printing head 103, and feed the information to CPU 402.

Figure 4:
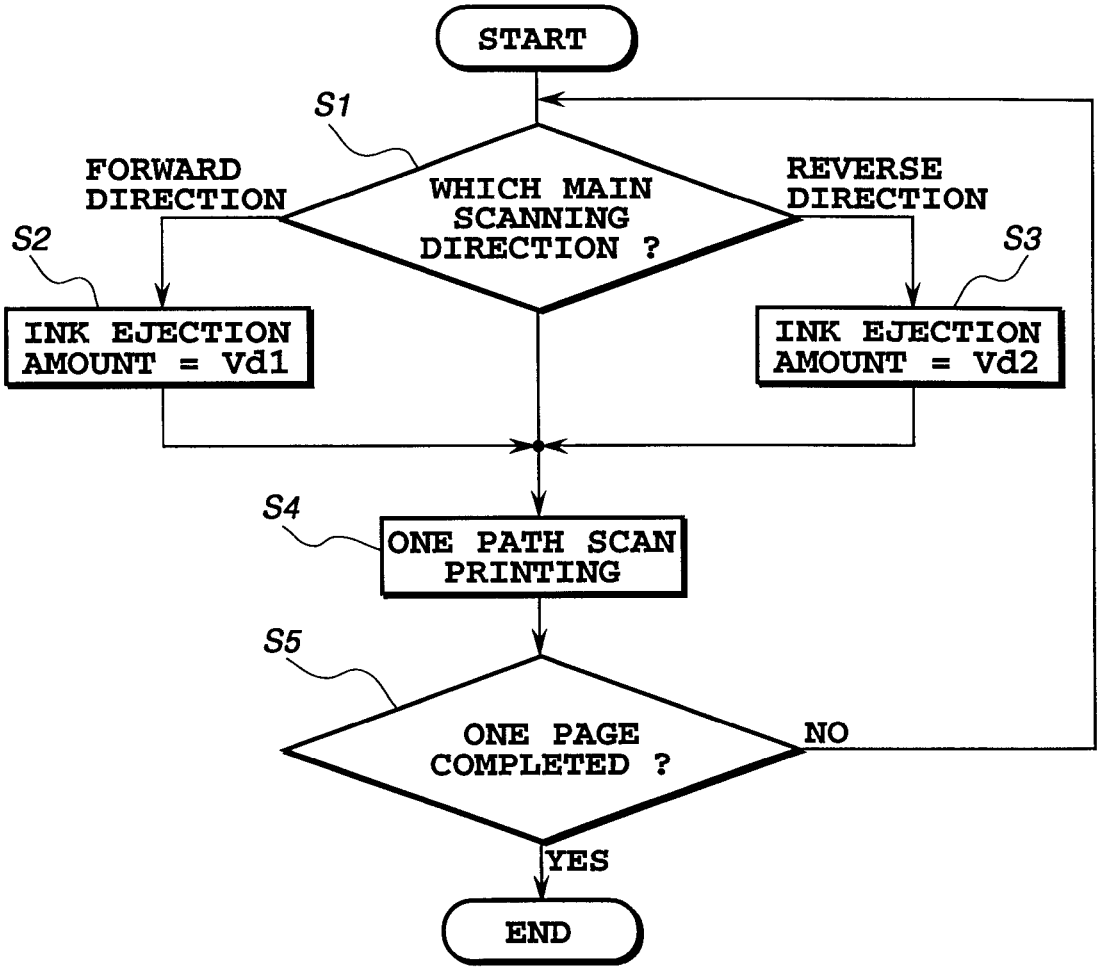
FIG. 4 is a flowchart of a printing operation in the first embodiment according to the present invention.

FIG. 4 is a flowchart for explaining printing operation. Here, explanation will be given for the case where printing of one page is performed by one path bidirectional printing. One path bidirectional printing represents a printing operation, in which the carriage 101 is reciprocally shifted in the main scanning direction to perform printing operation in both of forward path and return path and printing region for one line is completed by one main scan either in the direction of arrow Q1 or Q2.

At first, at step S1 of FIG. 4, a direction of main scan of the carriage 101 is judged. A printing direction judging portion in the printing head control portion 410 makes judgment whether printing is to be performed in the forward direction or printing is to be performed in the reverse direction. Here, the forward direction represents the scanning direction of the carriage 101, in which the processing liquid is ejected at first and then the ink is ejected, and is represented by the direction of arrow Q1 in FIG. 2 in the shown embodiment. On the other hand, the reverse direction represents the scanning direction of the carriage 101, in which the ink is ejected at first and then the processing liquid is ejected, and is represented by the direction of arrow Q2 in FIG. 2 in the shown embodiment. Action of the processing liquid is a preliminary process of the printing medium 106 before printing by the ink in the forward direction, and is a post-process of the printing medium 106 after printing by the ink in the reverse direction. Normally, in one path bidirectional printing, odd number order of the main scan is forward direction and even number order of main scan is reverse direction.

When the scanning direction of the carriage 101 is the forward direction, an ejection amount of the ink is set at Vd1 at step S2, and then, the process is advanced to step S4. On the other hand, when the scanning direction of the carriage 101 is the reverse direction, the ejection amount of the ink is set at Vd2 at step S3, and then, the process is advanced to step S4.

A value of Vd2 is assumed to be 95% of a value of Vd1, in the shown embodiment. Particularly, in the reverse direction of the arrow Q2, a driving waveform of the printing head 103 is controlled so that the ejection amount (volume) of ink droplet becomes 95% of that in the forward direction of the arrow Q1. A control method of the ejection amount of the ink may be a known pulse width modulation method, or may be effected to reduce the ejection amount of the ink by controlling the temperature of the ink ejecting heads 103(Y) to 103(Bk) to be the lower temperature. Therefore, control means of the ink ejection amount is not limited. On the other hand, a ratio to reduce the ejection amount of the ink is the matter of design to be selected to an optimal value depending upon an ink and the processing liquid to be used, property of the printing medium 106 and so on. The control means for the ejection amount of the ink is provided in the printing head control portion 410. it should be noted that, in the shown embodiment, the ejection amounts of the processing liquid in the forward direction and the reverse direction are set to be the same as each other.

At step S4, according to the ejection amount of the ink set at step S2 or S3, printing operation for one scan in the forward path or the return path is performed. Then, at step S5, judgement is made whether printing for one page is completed or not. If printing for one page is not completed, the process returns to the foregoing step S1 to repeat the foregoing operation sequentially until printing for one page is completed.

Next, a reason why the ejection amount of the ink in the reverse direction is set to be smaller than that in the forward direction, will be explained.

FIGS. 5A to 5D are explanatory illustrations of a dot D1 of the ink and a dot D2 of the processing liquid to be formed on the printing medium 106. FIGS. 5A to 5D diagrammatically show a section of the printing medium 106, on which the dots D1 and D2 are formed.

Figure 5A:
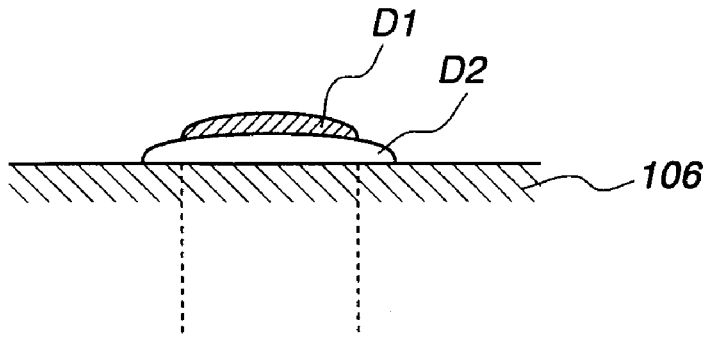
FIGS. 5A, 5B, 5C and 5D are explanatory illustrations of an ink dot to be formed by action of the ink and the processing liquid.
Figure 5B:
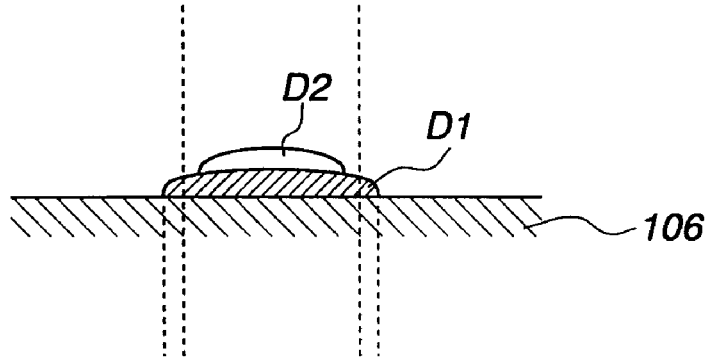
Figure 5C:
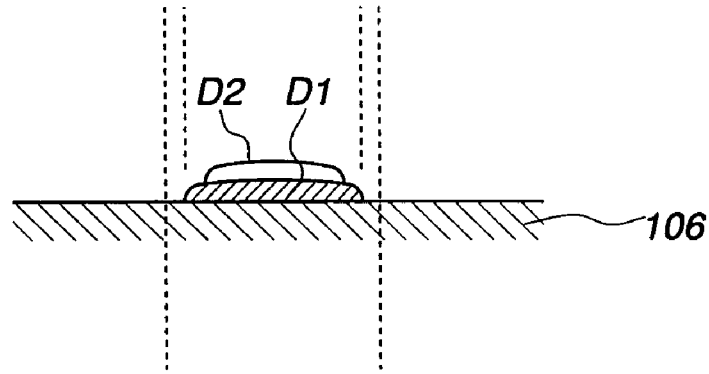
Figure 5D:
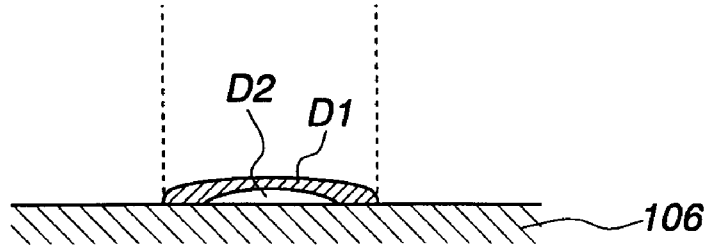

FIG. 5A shows a result of printing in forward direction (forward path), in which the processing liquid is ejected and then the ink is ejected, and FIG. 5B shows a result of printing in reverse direction (return path), in which the ink is ejected and then the processing liquid is ejected. In FIGS. 5A and 5B, the ejection amount of the ink is the same. FIG. 5C shows a result of printing in the reverse direction (return path), in which the ejection volume of the ink is smaller than that in the forward direction (forward path) of FIG. 5A. FIG. 5D is a result of printing in the forward direction (forward path), in which the ejection volume of the processing liquid is smaller than that in the reverse direction (return path) of FIG. 5B. The diameters of the dots D1 of the ink in FIGS. 5A and 5C are substantially the same, and the diameters of the dot D1 of the ink in FIGS. 5B and 5D are substantially the same.

Printing in the forward path of FIG. 5A is performed by ejecting the processing liquid at first for preliminary process and then ejecting the ink. Therefore, by reaction of the processing liquid and the ink, the diameter of the dot D1 of the ink is relatively small. In contrast to this, in printing in the return path of FIG. 5B, the ink is ejected at first to spread in relatively wide area on the printing medium 106, and then post-process is performed by ejecting the processing liquid. Thus, the diameter of the dot D1 of the ink becomes relatively large. Therefore, as shown in FIG. 5C, when the ejection volume of the ink is made smaller in printing in the return path, the diameter of the dot D1 of the ink can be close to the diameter of the dot D1 of the ink in the forward path of FIG. 5A.

When the diameters of the dots of the ink are different between the forward path and the return path, printing quality can be differentiated between the forward path and the return path to make it difficult to obtain uniformity of the printing quality. For example, in one path bidirectional printing, the characters may be varied to be thick and thin or high and low density in every other lines. This can be a cause to degrade printing quality.

In order to reduce difference of printing quality in the forward path in the forward direction and the return path in the reverse direction in such reciprocal printing, it is advantageous to make the ejection volume of the ink in the return path smaller than that in the forward path.

Here, compositions of the inks and the processing liquid are as follows:

| | |
|---|---|
| Y (yellow) ink | |
| glycerin | 5.0 Wt % |
| thiodiglycol | 5.0 Wt % |
| urea | 5.0 Wt % |
| isopropyl alcohol | 4.0 Wt % |
| Tradename: Acetylenol EH (Kawaken Fine Chemical K. K.) | 1.0 Wt % |
| dye C. I. direct yellow 142 | 2.0 Wt % |
| water | 78.0 Wt % |
| M (magenta) ink | |
| glycerin | 5.0 Wt % |
| thiodiglycol | 5.0 Wt % |
| urea | 5.0 Wt % |
| isopropyl alcohol | 4.0 Wt % |
| Tradename: Acetylenol EH (Kawaken Fine Chemical K. K.) | 1.0 Wt % |
| dye C. I. acid red 289 | 2.0 Wt % |
| water | 77.5 Wt % |
| C (cyan) ink | |
| glycerin | 5.0 Wt % |
| thiodiglycol | 5.0 Wt % |
| urea | 5.0 Wt % |
| isopropyl alcohol | 4.0 Wt % |
| Tradename: Acetylenol EH (Kawaken Fine Chemical K. K.) | 1.0 Wt % |
| dye C. I. direct blue 199 | 2.5 Wt % |
| water | 77.5 Wt % |
| Bk (black) ink | |
| glycerin | 5.0 Wt % |
| thiodiglycol | 5.0 Wt % |
| urea | 5.0 Wt % |
| isopropyl alcohol | 4.0 Wt % |
| dye food black | 3.0 Wt % |
| water | 78.0 Wt % |
| S (processing liquid) | |
| polyallylamine hydrochloride | 5.0 Wt % |
| alkydimethylbenzylammonium chloride | 1.0 Wt % |
| diethylene glycol | 10.0 Wt % |
| Tradename: Acetylenol EH (Kawaken Fine Chemical K. K.) | 0.5 Wt % |
| water | 83.5 Wt % |

Here, "Acetylenol EH" is a tradename and a name of it as chemical substance is "ethylene oxide -2, 4,7,9-tetramethyl-5-decyne-4,7,-diol".

As set forth above, acetylenol EH as a surface active agent is added in amount of 1.0 Wt % in the YMC inks in order to improve permeability of the YMC inks in comparison with the Bk ink. Therefore, the YMC inks are superior in fixing ability in comparison with the Bk ink. On the other hand, the Bk ink has slightly lower permeability in comparison with the YMC inks but has higher printing density to provide higher sharpness in the edge portion of the printing image and thus is suitable for character or line pattern. On the other hand, acetylenol EH is added in amount of 0.5 Wt % in the processing liquid to slightly improve permeability.

It should be noted that while an example, in which dyes are used as coloring agent of Y, M, C, Bk inks, the present invention is not specified to this. For example, the inks using pigment or mixture of dye and pigment as coloring agent, may also be used. Even in such case, equivalent effect can be obtained by using optimal processing liquid (S) effective for coagulating any one component of each ink containing the coloring agent and solvent.

On the other hand, the printing head 103 is not limited to one employing system for ejecting the ink and the processing liquid using the electrothermal transducer. For example, the printing head ejecting the ink or processing liquid using electromechanical transducer, may be employed.

On the other hand, in the shown embodiment, one path bidirectional printing has been explained exemplarily, the present invention is not specified to this. For instance, equivalent effect may be obtained even in printing operation to complete printing region for one line by two or more path bidirectional printing, namely, by two or more times of main scan in the direction of arrow Q1 or Q2.

(Second Embodiment)

While the ejection volume of the ink in the return path is made smaller than that in the forward path in the foregoing first embodiment, the same object can be accomplished by other methods.

Figure 6:
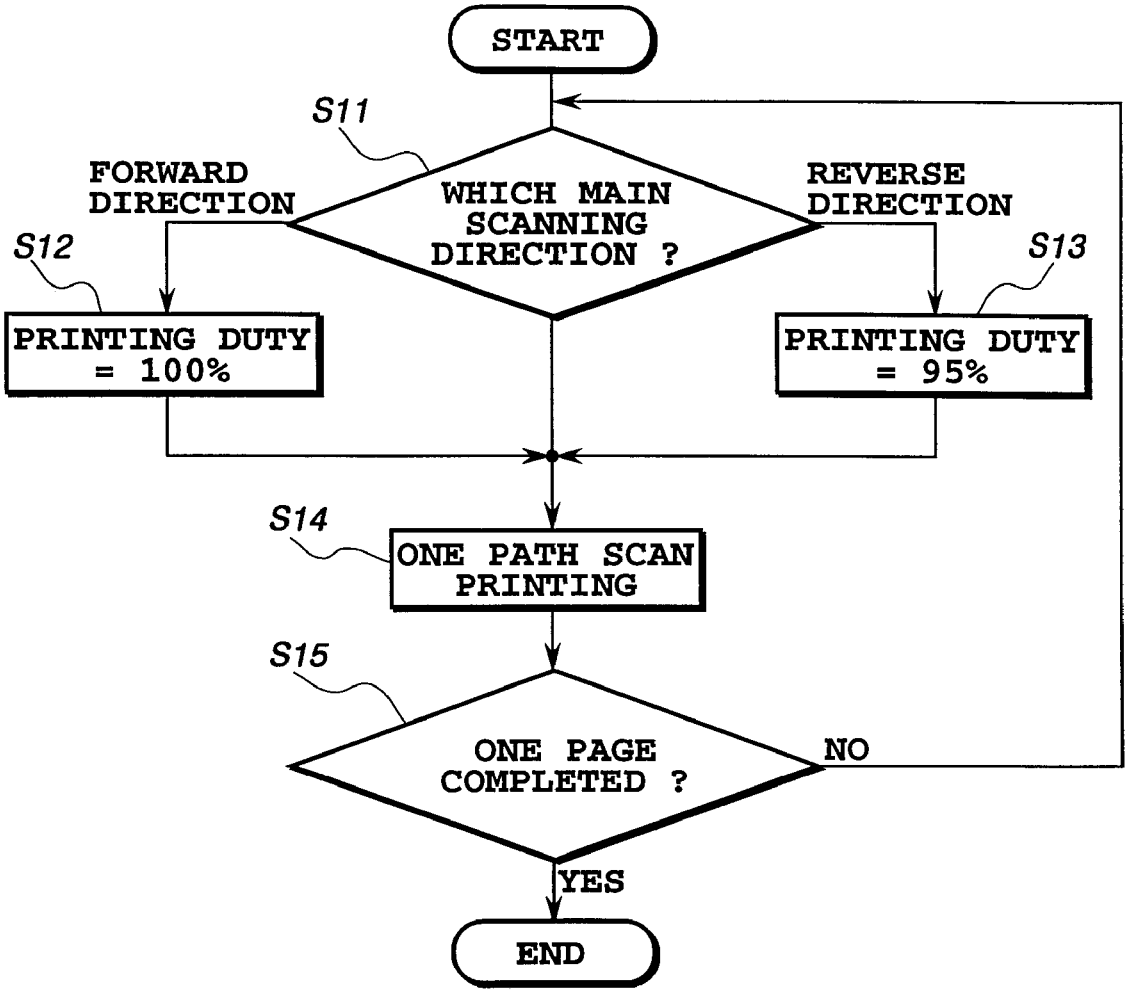
FIG. 6 is a flowchart of a printing operation in the second embodiment according to the present invention.

For example, the comparable effect can be obtained by reducing an ink amount to be ejected to the printing medium 106 per unit area in the return path in comparison with that in the forward path. This means that substantially the same effect as that obtained by controlling the ink droplet per each dot in macro sense, by controlling average ejection amount of the ink per unit area instead of controlling the ink droplet per one dot. At a printing resolution at least 300 dpi or more, the effect can be confirmed. Accordingly, the similar effect can be obtained by making a printing duty of the ink per unit area of the printing medium 106 smaller in the return path than the forward path. For example, in the return path, the printing duty is set at 95% of the that in the forward path. Namely, in the return path, the ink droplet 5% lesser than that in the forward path on the average may be ejected. FIG. 6 is a flowchart showing operation in the case where the printing duties in the return path and the forward path are differentiated.

(Third Embodiment)

In the foregoing first and second embodiments, the ejection volume of the ink in the return path is made smaller than that in the forward path. On the other hand, in order to reduce difference of the printing quality in the forward path and the return path, it may also be possible to make the amount of the processing liquid per unit area in the forward path smaller than that in the return path.

Comparing FIGS. 5B and 5D, the diameters of the ink dots D1 become substantially equal to each other. The reason why the diameter of the ink dot D1 of FIG. 5D becomes greater than that of the ink dot D1 of FIG. 5A is that the ink not reacted with the processing liquid and may easily spread on the surface of the printing medium 106. Accordingly, with the method to make the diameters of the ink dots D1 substantially equal to each other as in the case of FIGS. 5B and 5D, the difference of the printing quality in the forward path and the return path can be made small.

On the other hand, according to elapsed time, the processing liquid and the ink penetrate into the printing medium 106. The ink not reacted with the processing liquid may react with the processing liquid on the surface of the printing medium 106 or in a position slightly penetrated into the printing medium 106 from the surface to achieve the effect of reaction of the ink and the processing liquid. Therefore, by setting the ejection amount of the processing liquid in the forward path relatively smaller than that in the return path, or by setting an ejection duty of the processing liquid in the forward path smaller than that in the return path, the equivalent effect to that obtained in the former embodiments can be achieved.

(Fourth Embodiment)

In the foregoing first and second embodiment, the ejection volume of the ink in the return path is set to be relatively smaller than that in the forward path, and in the foregoing third embodiment, the amount of the processing liquid per unit area in the forward path is set to be relatively smaller than that in the return path.

The equivalent effect may be obtained by combining both ways. In such case, the content of the process in each way may reduce the degree of reduction of the ejection amount of the ink and the processing liquid.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 $\mu$m in pore size (tradename: fuloropore filter manufactured by Sumitomo Electric Industries, Ltd.), and thereafter, pH of the mixture is adjusted to a level of 4.8 by adding sodium hydroxide whereby liquid A1 can be obtained.

[Components of A1]

| | |
|---|---|
| low molecular weight ingredients of cationic compound; stearyl-trimethyl ammonium salts (tradename: Electrostriper QE, manufactured by Kao Corporation), or stearyl-trimethyl ammonium chloride (tradename: Yutamine 86P, manufactured by Kao Corporation) | 2.0 parts by weight |
| high molecular weight ingredients of cationic compound; copolymer of diarylamine hydrochloride and sulfur dioxide(having an average molecular weight of 5000) (tradename: polyaminesulfon PAS-92, manufactured by Nitto Boseki Co., Ltd) | 3.0 parts by weight |
| thiodiglycol; | 10 parts by weight |
| water | balance |

Preferable examples of ink which becomes insoluble by mixing the aforementioned processing liquid can be noted below.

Specifically, the following components are mixed together, the resultant mixture is pressure-filtered with the use of a membrane filter of 0.22 $\mu$m in pore size (tradename: Fuloroporefilter, manufactured by Sumitomo Electric Industries, Ltd.) so that yellow ink Y1, magenta ink M1, cyan ink C1 and black ink K1 can be obtained.

[Yellow ink Y1]

| | |
|---|---|
| C. I. direct yellow 142 | 2 parts by weight |
| thiodiglycol | 10 parts by weight |
| acetynol EH (tradename manufactured by Kawaken Fine Chemical Co., Ltd.) | 0.05 parts by weight |
| water | balance |

[Magente ink M1]

having the same composition as that of Y1 other than that the dyestuff is changed to 2.5 parts by weight of C. I. acid red 289.

[Cyan ink C1]

having the same composition as that of Y1 other than that the dyestuff is changed to 2.5 parts by weight of acid blue 9.

[Blak ink K1]

having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a printing medium usable for carrying out the present invention, there is no specific restriction, so called plain paper such as copying paper, bond paper or the like conventionally used can preferably be used. Of course, coated paper specially prepared for ink jet printing and OHP transparent film are preferably used. In addition, ordinary high quality paper and bright coated paper can preferably be used.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the processing liquid A1 previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average molecular weight of 6000, neutralizing agent: potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

(Composition of Carbon Black Dispersing Element)

| | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylen-acrylic acid methyl methaacrylate having an acid value of 280 and an average molecular weight of 11,000, neutralizing agent:diethanolamine) is used as a dispersing agent and dispersive treatment is conducted in the same manner as production of the black ink K2 whereby yellow color dispersing element having a weight-average grain size of 103 nm is produced.

(Composition of Yellow Dispersing Element)

| | |
|---|---|
| P-2 aqueous solution (having a solid ingredient of 20%) | 35 parts |
| C. I. pigment yellow 180 (tradename: Nobapalm yellow PH-G, manufactured by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced by using the anionic high molecular P-1 used when producing the black ink K2 as dispersing agent, and moreover, using the following materials by conducting dispersing treatment in the same manner as the carbon black dispersing element.

(Composition of Cyan Colored-Dispersing Element)

| | |
|---|---|
| P-1 aqueous solution (having solid ingredient of 20%) | 30 parts |
| C. I. pigment blue 153 (tradename: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

(Composition of the Magenta Colored Dispersing Element)

| | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus using an ink ejecting head for ejecting an ink, and a processing liquid ejecting head for ejecting a processing liquid which makes a coloring agent in said ink insoluble or coagulated, an ink dot being formed on a printing medium by said ink ejected from said ink ejecting head, and a processing liquid dot being formed on said printing medium by said processing liquid ejected from said processing liquid ejecting head, for forming a preliminary process portion, in which said ink dot is formed after formation of said processing liquid dot, and a post-process portion, in which said processing liquid dot is formed after formation of said ink dot, said apparatus comprising:

means for driving said ink ejecting head; and means for driving said processing liquid ejecting head, wherein at least one of a total ejected amount of said ink per unit area and a total ejected amount of said processing liquid per unit area is different between said preliminary process portion and said post-process portion so that the diameter of said ink dot of said preliminary process portion and the diameter of said ink dot of said post-process portion become substantially the same size.

2. An ink-jet printing apparatus as claimed in claim 1, wherein the ejection amount of said ink per unit area in said post-process portion is smaller than the ejection amount of said ink per unit area in said preliminary process portion.

3. An ink-jet printing apparatus as claimed in claim 1, wherein an amount of a unit ink droplet for said post-process portion is smaller than the amount of the unit ink droplet for said preliminary process portion.

4. An ink-jet printing apparatus as claimed in claim 1, wherein an ejection duty of the ink per unit area for said post-process portion is smaller than the ejection duty of the ink per unit area for said preliminary portion.

5. An ink-jet printing apparatus as claimed in claim 1, wherein the ejection amount of the processing liquid per unit area in said preliminary process portion is smaller than the ejection amount of the processing liquid per unit area in said post-process portion.

6. An ink-jet printing apparatus as claimed in claim 1, wherein an amount of a unit processing liquid droplet for said preliminary process portion is smaller than the amount of the unit processing liquid droplet for said post-process portion.

7. An ink-jet printing apparatus as claimed in claim 1, wherein an ejection duty of the processing liquid per unit area for said preliminary process portion is smaller than the ejection duty of the processing liquid per unit area for said post-process portion.

8. An ink-jet printing apparatus as claimed in claim 1, wherein said ink ejecting head comprises a plurality of ejection heads for ejecting different kinds of ink.

9. An ink-jet printing apparatus as claimed in claim 1, which further comprises:

moving means for moving said ink ejecting head and said processing liquid ejecting head in a main scanning direction; and transporting means for transporting said printing medium in a sub scanning direction substantially perpendicular to said main scanning direction.

10. An ink jet printing apparatus as claimed in claim 1, wherein said ink contains an anionic dye, and said processing liquid contains a low molecular component and a high molecular component of a cationic high molecular weight material.

11. An ink-jet printing apparatus as claimed in claim 1, wherein said ink contains at least an anionic compound and a pigment, and said processing liquid contains a low molecular and a high molecular component of cationic component substance.

12. An ink-jet printing apparatus as claimed in claim 1, wherein said ink ejecting head and said processing liquid ejecting head have electrothermal transducers causing a film boiling for ejecting said ink and said processing liquid.

13. An ink-jet printing method using an ink ejecting head for ejecting an ink, and a processing liquid ejecting head for ejecting a processing liquid which makes a coloring agent in said ink insoluble or coagulated, an ink dot being formed on a printing medium by said ink ejected from said ink ejecting head, and a processing liquid dot being formed on said printing medium by said processing liquid ejected from said processing liquid ejecting head, for forming a preliminary process portion, in which said ink dot is formed after formation of said processing liquid dot, and post-process portion, in which said processing liquid dot is formed after formation of said ink dot, said method comprising the step of:

driving said ink ejecting head and said processing liquid ejecting head such that at least one of a total ejected amount of said ink per unit area and a total ejected amount of said processing liquid per unit area between said preliminary process portion and said post-process portion so that the diameter of said ink dot of said preliminary process portion and the diameter of said ink dot of said post-process portion become substantially the same size.

* * * * *

UNITED STATES PATENT AND TRADEMARK OFFICE

CERTIFICATE OF CORRECTION

PATENT NO. : 6,467,891 B2
DATED : October 22, 2002
INVENTOR(S) : Jiro Moriyama et al.

It is certified that error appears in the above-identified patent and that said Letters Patent is hereby corrected as shown below:

Column 1,
Line 44, “solved” should read -- dissolved --;
Line 46, “complicate” should read -- complicated --; and
Line 57, “preliminarily” should read -- preliminary --.

Column 2,
Line 38, “preliminarily” should read -- preliminary --.

Column 5,
Line 15, “it” should read -- It --.

Column 7,
Line 3, “specified” should read -- restricted --.

Column 8,
Line 64, “[Magente” should read -- [Magenta --.

Column 9,
Line 5, “[Blak” should read -- [Black --.

Column 10,
Line 40, “stylen-acrylic” should read -- styrene-acrylic --; and
Line 41, “methaacrylate” should read -- methacrylate --.

Signed and Sealed this

Seventh Day of October, 2003

JAMES E. ROGAN
*Director of the United States Patent and Trademark Office*